United States Patent [19]

Lee

[11] 4,222,305

[45] Sep. 16, 1980

[54] TOOL FOR INSTALLING PRIMERS IN AMMUNITION CARTRIDGES

[76] Inventor: Richard J. Lee, 3146 Kettle Moraine Rd., Hartford, Wis. 53027

[21] Appl. No.: 1,494

[22] Filed: Jan. 8, 1979

[51] Int. Cl.[2] ..... F42B 33/10

[52] U.S. Cl. ..... 86/37; 86/44

[58] Field of Search ..... 86/23, 33, 24, 37, 44, 86/45

[56] References Cited

U.S. PATENT DOCUMENTS

| | | | |
|---|---|---|---|
| 3,082,660 | 3/1963 | Robertson | 86/44 |
| 3,240,103 | 3/1966 | Lamont | 86/45 |
| 3,555,959 | 1/1971 | Lee | 86/37 |
| 3,973,465 | 8/1976 | Bachhuber et al. | 86/45 |
| 4,142,441 | 3/1979 | Schaenzer | 86/37 |

*Primary Examiner*—Harold J. Tudor

*Attorney, Agent, or Firm*—Ralph G. Hohenfeldt

[57] ABSTRACT

A tool for inserting primers in shell casings comprises an elongated body, a carrier element engageable with the body, a primer cap driving pin slideable in the carrier element in opposition to a coil spring surrounding the pin, a shell holder supported in the body, a hand operating lever hooked onto a pin in the body, and a toggle link pivoted on the lever for driving the pin axially wherein all parts are constrained in assembled condition by force derived from the spring.

13 Claims, 7 Drawing Figures

TOOL FOR INSTALLING PRIMERS IN AMMUNITION CARTRIDGES

This invention relates to a hand operated tool for installing primers in ammunition cartridges for use in pistols, rifles and shotguns.

The new tool has several features which are improvements over a predecessor which it resembles in some respects. The predecessor tool is described in my prior U.S. Pat. No. 3,555,959, dated Jan. 19, 1971.

Portable primer inserting tools of the type herein described are intended for use primarily in the field in connection with reloading cartridges which have been previously fired. For such purposes it is desirable to have a lightweight and compact but rugged and reliable primer insertion tool.

SUMMARY OF THE INVENTION

The new primer insertion tool has some of the features of the one that is shown in the previously mentioned patent. It comprises an elongated preferably die cast metal body having a length about equal to the width of the average adult hand. A holder for receiving the rim of a cartridge or shell casing in which a new primer is to be inserted is mounted at one end of the body. A primer setting pin or plunger is supported in the body for being driven in one longitudinal direction to force a primer cap, which has been supplied to the holder, into the rim or head end of the shell casing. A coil spring surrounding the pin biases it to a retracted position in the body. A hand operated lever is pivotally mounted to the body. The lever has a connecting rod, called a toggle cam link, pivotally connected to it. The cam link makes rolling contact with the end of the primer driving pin. Privoting the hand lever in one direction toggles the cam link which drives the pin to set a primer cap in a shell casing. Release of the hand lever allows it to be restored to unactuated position and allows the pin to be retracted under the influence of the spring.

One new feature of the tool described herein is that all of its separable parts are actually held together by the force derived from the one spring. This is effectuated in part by having the primer setting pin and the spring mounted in a carrier element which is preferably molded plastic. This element has a T-shaped tongue on it. The head of the T fits through a hole in one side of the tool body and can be slid forward toward the shell holder end of the body whereupon it enters a narrower slot which prevents it from falling out of the body. A shell holder is captured in a groove or saddle at one end of the body. The end of the pin is slideable through a hole in the shell holder. The primer cap setting pin has a head which the toggle link cams axially. The spring surrounding the pin is interposed between the head of the pin and a part of the carrier element to obtain the spring return action. The carrier element has opposed resilient fingers on it between which the head of the pin can be easily pressed to insert it in the carrier element but which have sufficient resilience to resist having the head pass back or fall out from between the fingers inadvertently. Thus, the spring, headed pin and carrier element constitute a subassembly or unit.

The manually operated lever and its connected toggle link are installed in the body of the tool together. The lever has a hook-shaped part which slides over a pivot pin that is fixed in the body. The pivot pin is preferably cast integrally with the body. When this part of the assembly is accomplished, the toggle link, acting on the pin head, preloads the spring and drives it forward sufficiently for its end to start through the shell holder. Loading of the spring develops a force which is transmitted through the carrier unit and applied to the shell holder to retain it securely in its saddle groove. If the user desires to change shell holders to accommodate a different size shell rim, the user only needs to apply a small longitudinally directed force to the carrier element is opposition to the force of the spring for releasing the shell holder so that it may be withdrawn without resistance. A different holder is then substituted.

An object of the present invention is to provide a primer insertion tool which can be easily assembled in the factory and which can be easily assembled and disassembled for the purpose of substituting parts by the user without resorting to use of any other tools.

A more fundamental object of the invention is to provide a primer insertion tool wherein all of the parts are maintained in an assembled arrangement under the influence of a single spring.

How the foregoing and other more specific objects of the invention are achieved will be apparent in the more detailed description of an illustrative embodiment of the invention which will now be set forth in reference to the drawings.

DESCRIPTION OF A PREFERRED EMBODIMENT

Figure 1:
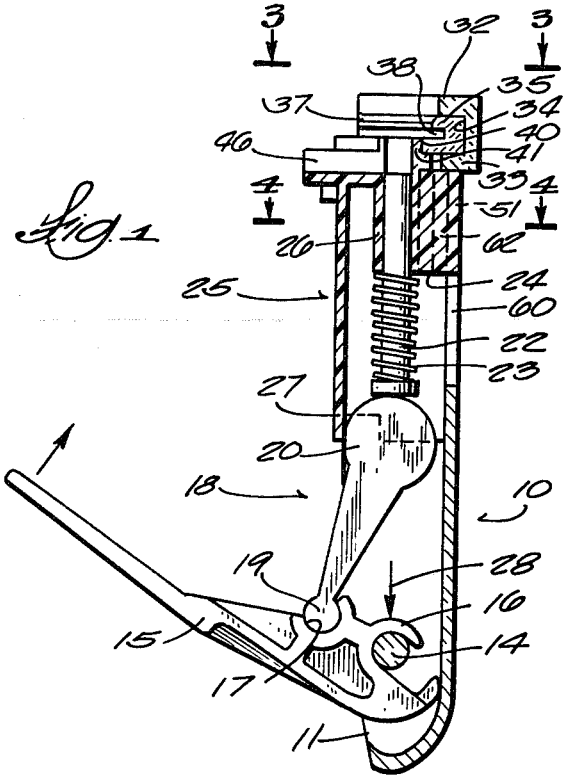
FIG. 1 is a longitudinal sectional view through the new primer inserting tool, showing the primer setting pin in its retracted position.
Figure 2:
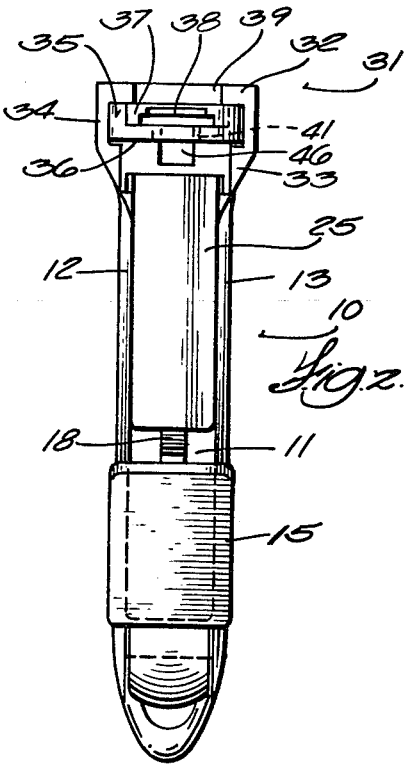
FIG. 2 shows the assembled tool as viewed toward the side from which the manual operating lever extends.

Referring to FIGS. 1 and 2, the tool comprises a preferably cast metal body 10 which is basically a tubular element that has an elongated opening 11 on one side which is substantially coextensive with the length of the body. The edges of body 10 are the side boundaries of the elongated opening 11 marked 12 and 13. As can be seen particularly well in FIG. 1, a fixed pin 14 is cast integrally with body 10 and extends across the body. Pin 14 is accessible through the side opening 11 of body 10. A manual operating lever 15 is adapted for pivoting on pin 14. For this purpose the lever is provided with a hook-shaped portion 16 which serves as a pivot bearing. Lever 15 also has a laterally extending curved open-sided socket 17. A connecting rod constituting a combination cam and toggle link 18 has a cylindrical bearing portion 19 which slips axially into socket 17. The curvature of the socket extends around a sufficient part of the cylindrical portion so it cannot slip out of the side opening. Thus, toggle link 18 is pivotally connected to manual operating lever 15. Toggle link 18 also has a circular cam portion 20 at one end which reacts against the head 21 of primer cap driving or setting pin 22. Pin 22 is movable axially to drive a primer cap into the head of a shell casing as will be explained later.

Pin 22 is surrounded by a coil spring 23. This spring is interposed between the head 21 of pin 22 and a face 24 of a carrier element which is generally designated by the reference numeral 25. The carrier element 25 engages with the body 10 of the tool in dove-tail fashion as will be explained. For the time being it is sufficient to note that the carrier element 25 has a bore 26 in which primer cap setting pin 22 is slideable.

It will be evident in FIG. 1 that when lever 15 is pivoted clockwise on fixed pin 14, the connecting rod toggle link 18 will become substantially aligned with the length of the lever and will be extended toward the end of the tool body in which the head or rim end of a shell casing is held for having a primer inserted in it. This increased alignment of the lever 15 and toggle link 18, of course, causes pin 22 to advance axially and spring 23 to be compressed. When manual lever 15 is released, the force of spring 23, acting through pinhead 21, is applied to the cam end 20 of the toggle link to thereby cause the manual operating lever 15 to be restored to the position in which it is shown in FIG. 1.

An overhanging part 27 of carrier element 25 captures the cam end 20 of line 18 in such fashion that the cam end can slide within the carrier body and exert a force on pinhead 21. When the lever is unactuated as in FIG. 1, of course, spring 23 is only slightly loaded so that the counterforce is small. However, there is enough force at this time for a reasonable force to be developed between the hook 16 of the lever and fixed pin 14 for the hook 16 to be retained on the pin 14. One component of the force is indicated by the vector or arrow marked 28. The force is applied to the pin by the hook at a point which tends to keep these two parts together. To disassemble the tool the user may apply a force to the lever in opposition to the force component 28 and at substantially 45° to it to cause the hook 16 to clear pin 14 and then the toggle link can be pivoted enough to permit the whole handle and link to be withdrawn from the body 10 of the tool.

Assembly, that is, the converse of disassembly which has just been described, involves having the toggle link 18 pivotally connected to the lever 15 as described and then inserting the cam 20 end of the link into the opening in carrier 25 while at the same time compressing spring 23 and moving pin 22 sufficiently to allow the hook 16 to slide over fixed pin 14. When the hook is in place, the operating lever can be released and the reactive forces are such that the lever and all of the other parts will stay in place.

Figure 3:
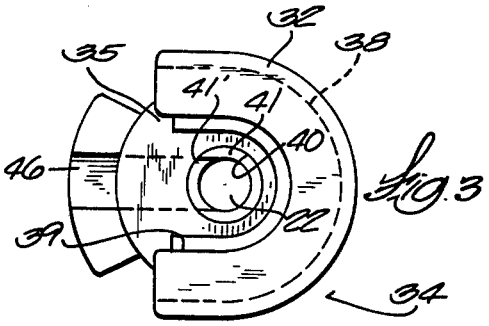
FIG. 3 shows the end of the tool as viewed in the direction of the arrows 3—3 in FIG. 1.

As can be seen particularly well in FIGS. 2 and 3, one end 31 of tool body 10 is enlarged diametrically. This end portion has a front wall 32 and a rear wall 33. These walls are spaced from each other to define a substantially semicircular groove or open-sided saddle 34. The saddle is for accommodating a shell holder 35 which has a flat rear side 36 and an open side 37 as can be seen in FIGS. 1 and 2. The interior of shell holder 35 has an appropriately shaped groove 38 for capturing the rim of a shell casing which is to be reprimed and which is not shown in any of FIGS. 1–5 but is shown in dashed lines and marked 56 in the FIG. 7 embodiment. The shape of rim groove 38 can be seen in FIG. 3 also. Adjacent groove or saddle 34, wall 32 of the enlarged part 31 of the body 10 is provided with a slot 39 through which the body of the shell casing or cartridge may extend when its rim is captured in shell holder 35.

As can be seen in FIGS. 2 and 3, shell holder 35 is a separable disk-like object that has a central bore 40 through which primer setting pin 22 may advance and retract. Bore 40, however, is large enough to accommodate an extension 41 which has a side opening 41' and extends from an end of carrier element 25. The extension 41, as a result of passing into the bore 40 of shell holder 35 acts as a detent to retain the shell holder in the groove or saddle 34 of the tool body. When the user desires to remove shell holder 35, such as for substituting one for a different sized shell, the user simply has to apply an axial force with his thumb to the carrier body 25 so as to slide it in tool body 10 sufficiently for extension 41 to become withdrawn from bore 40 in shell holder 35. The shell holder 35 is then free to drop out of its saddle 34 and, as long as the carrier retracting force is applied, there will be clearance for inserting another shell holder. When a substitute shell holder is in place, the user takes the force off the carrier and allows it to advance under the influence of spring 22 so as to reengage the shell holder by means of extension 41. This is a further illustration of how parts of the tool are held together with a single spring.

Figure 5:
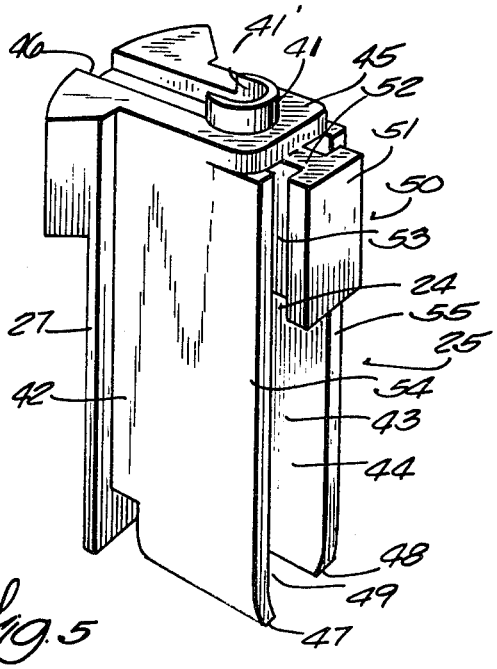
FIG. 5 is an isolated perspective view of the carrier element which is used in the tool prior to the primer setting pin and spring having been installed in it.

Attention is now invited to the carrier element 25 which is shown enlarged and isolated from the tool assembly in FIG. 5. This element is molded as a unitary plastic object. Carrier element 25 has a pair of sidewall extensions 42 and 43 which define a space 44 between them. The top face 45 of the element 25 as depicted in FIG. 5 abuts against the flat face 36 of the shell holder in the grooved saddle 34 under the force of spring 22 when the tool is assembled as in FIG. 1. In FIG. 5 one may see the projection 41 which extends into the shell holder 35 to retain it positively. As explained earlier, extension 41 has a side opening 41'. This opening is aligned with a channel 46 in end face 45 of the carrier element. In the FIG. 1 embodiment, primer caps are fed successively into channel 46 and fall through opening 41' to align them with the hole for pin 22 in the shell holder. Then, when the handle 15 is operated, pin 22 is driven axially to set the primer cap in the shell or cartridge casing that is presently in the holder 35.

Note in FIG. 5 that the ends 47 and 48 of sidewalls 42 and 43 are bent or offset toward each other but spaced apart by a gap 49 which is slightly narrower than the width of space 44. Since the carrier element is made from a suitable plastic the offset portions 47 and 48 are resilient and can be sprung toward and away from each other like flat springs. These ends 47 and 48 are resilient enough to permit pin 22 to be inserted into the carrier while the head 21 of the pin expands ends 47 and 48 outwardly. The inherent elasticity of the ends 47 nd 48 then restores them to the positions in which they are shown in FIG. 5 in which case gap 49 is at its minimum size and head 21 of the pin cannot back out through the gap unless a substantial force is applied to the pin to overcome the resilience again. Thus, the pin, and of course, spring 23 which then surrounds it cannot back out of the gap 49 unless an adequate force is intentionally applied. The pin 22, spring 23 and the carrier 25 then constitute a subassembly which can be inserted in the tool body as a unit.

The carrier element 25 in FIG. 5 has an integral T-shaped element 50 which is for interlocking it with tool body 10. This element has a head portion 51 joined with a leg 52. Head 51 defines a gap such as 53 on each of its sides with the respective edges 54 and 55 on sidewalls 42 and 43 of the carrier element. The overall width of carrier element 25 from outside to outside of its sidewalls 42 and 43 is slightly less than the width of the gap 11 which runs longitudinally of the tool holder body 10.

Figure 4:
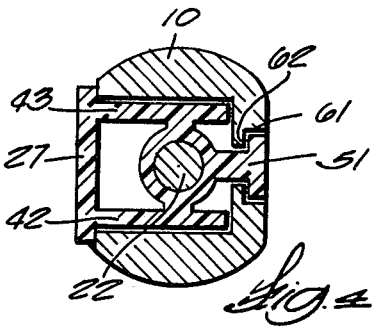
FIG. 4 is a transverse section of the tool taken on a line corresponding with 4—4 in FIG. 1.

For the purposes of enabling carrier element 25 to be inserted in and interlocked in tool body 10, the closed bottom of body 10 is provided with an elongated slot 60 as can be seen in FIG. 1. The length of slot 60 is at least as great as the length of the flat head 51 of T-shaped element 50 so that this head will pass freely through the slot 60 when the carrier element is put into the open sided body 10. As can be seen in FIG. 4, contiguous endwise with slot 60 is a narrower slot 61 which defines a shoulder 62 on body 10. After head 51 passes freely through slot 60, it is pushed forward by the assembler so that the T-head 51 advances in slot 61 and interlocks as is evident from inspection of FIG. 4. Then, when the handle 15 and toggle link of connecting rod 18 are joined with each other and put in place on pin 14 as described earlier, spring 23 becomes slightly loaded and presses carrier element 25 against shell holder 35. Extension 41 on the carrier 25 then enters the shell holder 35 to keep it interlocked. This completes assembly of the entire tool.

Referring further to FIG. 1, 2 and 3, it should be evident that the user may insert primer caps, one at a time if desired, into channel 46 which is formed in carrier 25 immediately behind where it interfaces with the shell holder. With the handle 15 in its unactuated position as in FIG. 1, the primer cap will fall into alignment with primer cap setting pin 22. When the handle is squeezed or pivoted about pin 14, link 18 will toggle and drive the pin in a direction which forces the primer cap into the rim end of a cartridge or shell casing that is accommodated in the shell holder 35.

Figure 7:
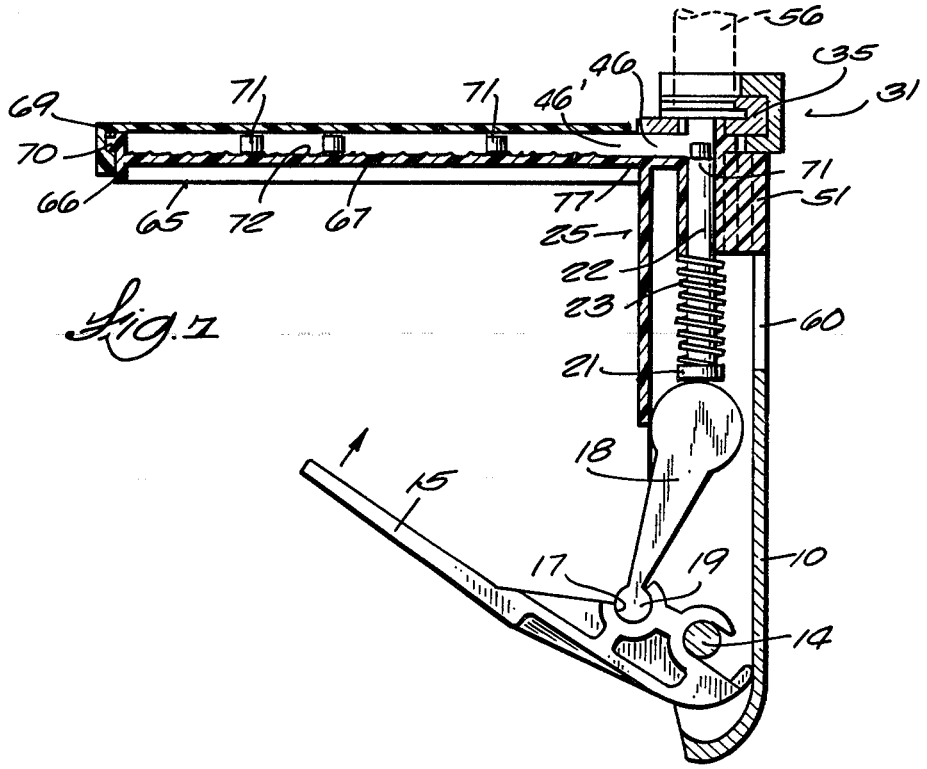
FIG. 7 is a longitudinal sectional view of the tool shown in FIG. 6.

The modified embodiment shown in FIGS. 6 and 7 will now be discussed. In this embodiment, parts which have the same construction as in the FIG. 1–4 embodiment are assigned the same reference numerals. In the FIGS. 6 and 7 embodiment, a container, called a tray, is provided for storing dozens of primer caps which can be fed into the tool under the influence of gravity so that each primer cap does not have to be handled individually.

The tray is generally designated by the reference numeral 65. It comprises a circular wall 66 having a bottom 67 and a transparent cover 68. It also has lugs 69 which cooperate with pins 70 that enable cover 68 to be turned and locked onto the tray in bayonet fashion. The wall 66 of the tray has a throat 46' for discharging from the tray primer caps such as those marked 71 in FIG. 7 into the tool in succession when the tool is held at an angle of about 45° with respect to horizontal so that gravity will influence the primer cap 71 to move into the tool.

Figure 6:
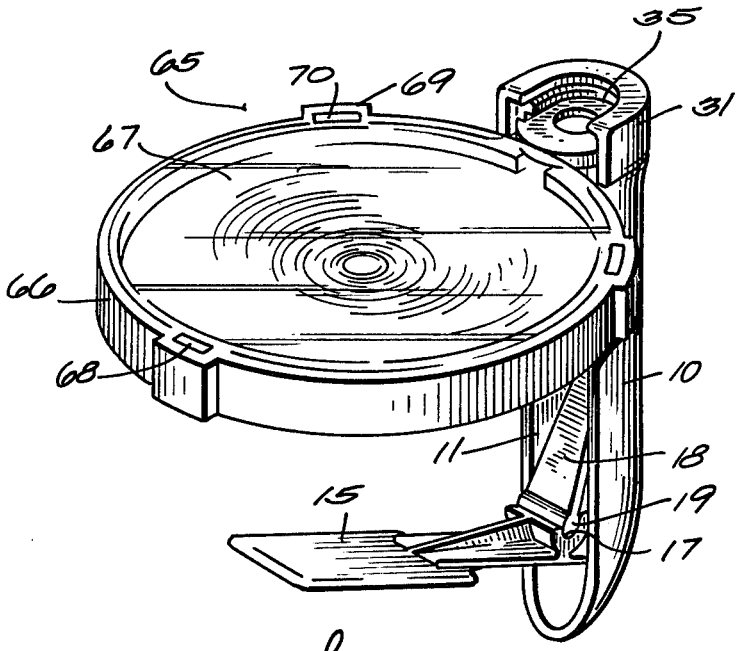
FIG. 6 is a perspective view of an alternative embodiment of the tool which is equipped with a closed tray for storing primer caps.

Handheld tool body 10 has a side opening 11, as can be seen in FIG. 6, as in the previously described embodiment. The same kind of handle 15 and toggle link 18 are used but, in the FIGS. 6 and 7 embodiment, the carrier element 25 is formed integrally with the bottom 67 and sidewall 66 comprising tray 65. The interlocking T-head 51 of the carrier 25 in FIG. 7 need not be described because this part is similar to the interlocking element in the previously described embodiment. A neck portion 77 of the tray, however, is molded integrally with carrier 25. This neck portion has the channel 46 which delivers the primer caps 71 from throat 46' to the place where they are aligned with primer setting pin 22.

Note that the bottom 67 of the tray has a large number of circular and concentric ridges which cause the primer caps 71 to turn in the proper orientation if they are misoriented so they can be pressed directly into the cartridge casing 39 without attention having to be paid to their orientation.

In summary, a primer inserting tool has been described, in one embodiment of which there are seven separable parts; a body, a lever, a connecting rod or toggle link, a shell holder, a carrier element, a headed primer setting pin and a spring, all of which parts are held together by forces derived from the spring to form an operative primer inserting tool. Shell holders can be exchanged by simply pressing against the carrier element to oppose the spring and thereby release the shell holder from the element which retains it. The carrier element and the spring and the pin which it contains will not disassemble inadvertently because the carrier element has resilient portions for constraining these parts to remain assembled. Thus, the likelihood of a user in the field dropping and losing a small part is substantially eliminated. There are no parts with threads or any other fastening means that might become cross threaded or deformed to make use of the tool difficult in the field as is the case with some prior art devices.

Although preferred embodiments have been described in considerable detail, such description is intended to be illustrative rather than limiting, for the invention may be variously embodied and is to be limited only by interpretation of the claims which follow.

I claim:

1. A tool for inserting primers in cartridges comprising:

an elongated generally hollow body having a socket at one end into which an apertured cartridge holder is insertable and from which it is removable, said socket having means for limiting longitudinal movement of said holder in at least the direction outwardly from said body, a carrier member that is insertable in and removable from said body and is constrained to slide longitudinally in said body to engage with said holder and retain it in said socket when said carrier is moved in one direction and to enable removal of said carrier member when it is moved in an opposite direction, said member having a longitudinally extending bore aligned with said holder aperture, a primer setting pin extending through said bore of said carrier member, said pin having a head, and spring means interposed between said member and the head of the pin to bias said pin in one direction that tends to retract said pin from said holder, an operating lever having a free end for applying an operating force and having means for making a pivot connection with said body, a link element pivotally connected at one end to said lever intermediate of said free end and said pivot means of the lever, said link element extending at a first angle relative to said lever into contacting relation with the head of said pin means for preloading said spring and thereby causing said carrier member to be retained in said body and to be biased with a minor force toward engagement with said cartridge holder when said lever is at a first angle corresponding with its unoperated position, said link being projected in a direction to drive said pin through said holder and to increase the load on said spring and the engagement force of said member on said holder when said link is driven to another angle caused by pivoting said lever to an angle corresponding with its operated position.

2. The tool as in claim 1 wherein:

said means for making a pivot connection between said lever and said body comprises an open-sided hook-shaped element integral with said lever, stationary pin means in said body, said hook element being hooked on said pin means and arranged for deriving from said spring a component of force which is transmitted through said link and lever for maintaining said hook in engagement with said stationary pin means when said minor force exists to thereby meantain said member, spring, setting pin, lever, link, holder and lever in assembled condition with the minor force of said spring.

3. The tool holder as in claim 1 wherein:

said carrier member has a channel at one end for feeding a primer to said tool and a projection on said end for extending into said holder and for engaging it, said projection having an open side alinged with said channel and defining a recess for positioning a primer in line with said setting pin, said carrier element being manually engageable for moving it in opposition to the force of the spring to thereby release said holder.

4. The tool as in claim 1 wherein:

said carrier member has resilient means disposed along the path of movement of said head of the primer setting pin so that when said pin with said spring surrounding it is pushed in a direction to assemble said pin in the bore of said member, said resilient means will yield to let said head of the pin pass and then restore to unyielded position to thereby capture said pin and spring to form a unitary subassembly composed of said spring, said pin and said member.

5. The tool as in any one of claims 1, 2, 3 or 4 including a primer storage tray integral with said carrier and having a passageway for transferring primers from the tray to aligned position with said setting pin.

6. A tool for inserting primers in cartridges wherein all of the parts of the tool are maintained in assembled condition by forces derived from a single spring, said tool comprising:

an elongated body having a side opening at least partially coextensive with its length, an operating lever having means near one end for pivotally connecting to said body and a link element pivotally connected to said lever at a distance from said pivot means and extending into said body, said lever and link being angularly related to each other for executing toggle action, socket means at an end of said body remote from said pivot for enabling insertion and removal of a cartridge holder, a unit comprised of a carrier body that is removably engaged with said body and is constrained to slide in said tool body, a primer setting pin extending through said carrier body and a spring interposed between said carrier body and pin for exerting a force when compressed that tends to retract said pin from said body, and means for retaining said pin and spring in said carrier body, said link, when in a first angular relation to said lever, being disposed to apply a force to said pin and preload said spring for said spring to force said carrier body into engagement with a holder in said socket means, said link being toggled to a second angular relation with said lever when said lever is pivoted to thereby drive said pin longitudinally for setting a primer in a cartridge held in said holder and storing force in said spring for retracting said pin and restoring it and said lever to their said first angular relationship.

7. A tool for setting primers in cartridges comprising:

an elongated body having an open side substantially coextensive with its length, means defining an open-sided groove at a first end of said body into which a cartridge holder is insertable and from which it is removable, said holder having an aperture through which a primer may be driven for setting it in a cartridge, a unit comprised of a carrier member that is insertable into said elongated body through its side opening and has means for interlocking with said body in such fashion as to constrain it to slide longitudinally only, said unit having a headed longitudinally movable primer setting pin extending through it and a spring surrounding said pin and interposed between said member and the head of the pin, and means for retaining said pin and spring in said carrier body, lever means and means for selectively engaging and disengaging said lever means for pivoting on said elongated body, said lever means and said head of the pin being coupled to enable the force from said spring to maintain said lever means in engagement for pivoting, the reactive force between said lever and pin loading said spring for said spring to force said unit into engagement with a cartridge holder to thereby retain said holder in said groove.

8. The tool as in claim 7 wherein said carrier member has a portion that is accessible from the outside of said body for having a manual force applied thereto so that said member may be moved longitudinally in opposition to said spring for releasing said holder.

9. The tool as in claim 9 wherein said open-sided groove for said cartridge holder is defined by longitudinally spaced apart walls for accommodating said holder between them, one of said walls being effective to limit longitudinal movement of said carrier member due to the influence of said spring and to keep enough load on said spring for maintaining said lever in engagement when said holder is removed from said groove.

10. The tool as in any one of claims 7, 8, or 9 wherein said means for selectively engaging and disengaging said lever means and body includes an open-sided hook on said lever and a pin fixed in said body, said hook being shaped for encircling said pin sufficiently for maintaining said engagement under the influence of said spring and for sliding off and onto said pin when a manual force is applied generally lengthwise of said lever.

11. The tool as in claim 10 wherein said carrier member is made of plastic material having a resilient part extending therefrom for yielding under the influence of the head of said pin passing said part when said pin and surrounding spring are assembled into said member and for restoring to unyielded position to prevent inadvertent removal of said spring and pin.

12. A tool for inserting primers in cartridges comprising:

an elongated body having socket means at one end for inserting and removing an apertured cartridge holder element, operating lever means including means for making a releasable pivotal connection with respect to said body remotely from said one end, a unitary subassembly comprised of a carrier member, a headed primer setting pin for moving in said carrier member toward said holder for setting a primer and for moving away from said holder to enable insertion of a primer in said holder, a spring surrounding said pin and interposed between said head and said carrier member, means for inhibiting complete retraction of said pin from said carrier member, said carrier member being constrained to slide longitudinally in said body when said subassembly is installed in said body, and a link interposed between said lever and the head of said pin for receiving a force from said spring to maintain said pivotal connection and to enable maintaining said spring sufficiently loaded for it to force said carrier member into engagement with said cartridge holder such that all of the parts of said tool are held together with forces derived from said one spring.

13. The tool as in claim 12 wherein said carrier element comprises further a storage tray for primers forming an integral part of said carrier element, said tray having a passageway for transferring primers to alignment with said setting pin.

* * * * *

UNITED STATES PATENT AND TRADEMARK OFFICE

CERTIFICATE OF CORRECTION

PATENT NO. : 4,222,305

DATED : September 16, 1980

INVENTOR(S) : Richard J. Lee

It is certified that error appears in the above—identified patent and that said Letters Patent is hereby corrected as shown below:

Column 7, Line 17, "meantain" should read --maintain--

Column 7, Line 25, "alinged" should read --aligned--

Column 8, Line 45, "claim 9" should read --claim 8--

Signed and Sealed this

*Sixth* Day of *January 1981*

[SEAL]

*Attest:*

SIDNEY A. DIAMOND

*Attesting Officer*

*Commissioner of Patents and Trademarks*